United States Patent [19]

Booth

[11] 3,939,862

[45] Feb. 24, 1976

[54] HOSE REEL

[75] Inventor: William M. Booth, Grand Haven, Mich.

[73] Assignee: Edward E. Brondyke, Holland, Mich.

[22] Filed: May 22, 1974

[21] Appl. No.: 472,144

[52] U.S. Cl. ..... 137/355.16
[51] Int. Cl.[2] ..... B65H 75/34
[58] Field of Search..... 137/355.16, 355.17, 355.19, 137/355.23

[56] References Cited

UNITED STATES PATENTS 2,519,064 8/1950 Palm ..... 137/355.19

*Primary Examiner*—Henry T. Klinksiek
*Attorney, Agent, or Firm*—Price, Heneveld, Huizenga & Cooper

[57] ABSTRACT

A hose reel apparatus for garden and other type hoses which rewinds the hose after it has been pulled from the reel and automatically shuts off the flow of fluid through the hose and drains the fluid from the hose after it has been rewound. The apparatus includes a fluid motor powered by the fluid which is also directed through the hose, and fluid valving utilizing fluid pressure for stopping fluid flow through the hose. The valving is responsive to an increase in fluid pressure resulting from restriction in the rotation of the hose reel after the hose has been rewound.

16 Claims, 9 Drawing Figures

HOSE REEL

BACKGROUND OF THE INVENTION

This invention relates to hose reel apparatus for winding and storing garden and other type hoses and, more particularly, to a hose reel which automatically rewinds the hose utilizing the force of the fluid transmitted through the hose and automatically shuts off the flow of liquid after rewinding.

Hose reels for garden hose and other types of hoses are known. Many of the prior known devices have included complex mechanisms for turning on the flow of fluid through the hose when the hose is pulled from the reel, various mechanical and hydraulic means for rewinding the hoses on the reel, and various mechanical devices for shutting off the flow of fluid through the hose after the hose has been rewound. The major drawback of the prior devices has been their extremely complex construction making them expensive as well as subject to various forms of mechanical failure.

Specifically, prior reels have failed to provide simple and efficient apparatus for shutting off the flow of fluid after the hose has been rewound. A typical example is U.S. Pat. No. 2,193,288 disclosing one of the many prior known shut-off devices. This device includes numerous small, pivotable, and rotational elements subject to corrosion, and other elemental effects which can hinder or completely prevent proper operation.

Other drawbacks included the failure to provide simple and efficient means for evenly winding the hose on the reel. Many of the prior known winding devices used complex threaded or geared mechanisms which were also subject to breakdown and mechanical failure.

SUMMARY OF THE INVENTION

I have discovered that the above-mentioned drawbacks can be overcome with a simple and efficient hose reel apparatus which utilizes the power of the fluid flowing through the hose intended to be wrapped on the reel for both powering the rewinding of the hose and operating fluid valving to shut off the flow of fluid through the hose after rewinding. The pressure of the fluid transmitted through the hose is utilized, by setting a valve means for rewinding the hose, for both rewinding the hose on the reel and for shutting off the flow of fluid through the hose after rewinding. After rewinding, the fluid in the hose is automatically drained therefrom through the free end of the hose in order to prevent freezing, corrosion, or the like, especially if the fluid is water and the apparatus is used in cold or other adverse weather.

Preferably, an even-winding, following device is provided for guiding and directing the hose into a helical groove provided on the hose reel. The follower moves axially along a rod positioned parallel to the hose reel and includes an annular convex section engaging one axial portion of the helical groove and an annular concave section directing the hose into another portion of the groove spaced axially from the groove-engaging portion.

These and other objects, advantages, purposes, and features of the invention will become more apparent from a study of the following description when taken in conjunction with the drawings.

DESCRIPTION OF THE PREFERRED EMBODIMENT

Figure 1:
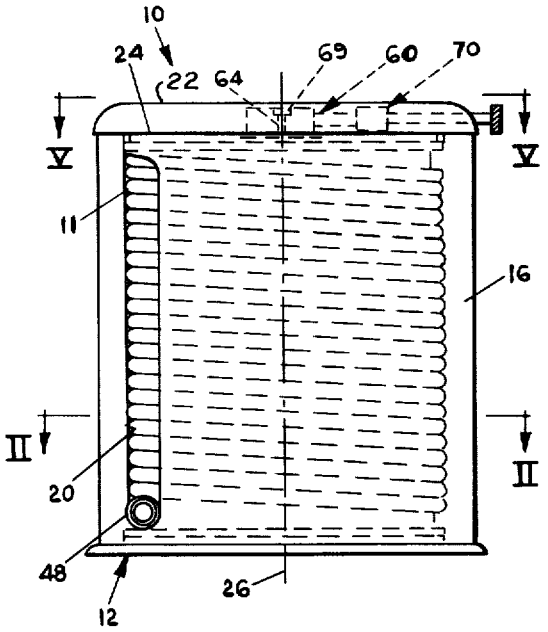
FIG. 1 is a side elevation of the present invention.

Referring now to the drawings in greater detail, FIGS. 1–3 and 5 generally illustrate the hose reel apparatus 10 of the present invention. The apparatus 10 includes a support structure 12 for housing and supporting the hose reel 25 (FIG. 3) for rotation about a generally vertical axis 26. Reel 25 receives a flexible hose 11 having a generally circular cross section therearound. Even wind mechanism 50 guides and directs hose 11 onto the reel 25. A fluid motor 60 is included for rotating the reel 25 about its vertical axis 26 through appropriate gearing, and fluid valving 70 is included for directing fluid through the hose only, or through the fluid motor 60 and through the hose, and for automatically shutting off the flow of fluid through the hose after the hose has been rewound to a predetermined point. The apparatus 10 is especially adapted for garden and other type hoses but may be adapted by changing its dimensions to handle virtually any type flexible hose.

Support structure 12 includes a base 14, a generally cylindrical housing 16, including a recess 18 having an elongated vertical aperture 20, and a top cover 22 over an upper platform 24. The cylindrical hose reel 25 is rotatably secured between base 14 and platform 24 with the hydraulic motor 60 and fluid valving 70 secured between platform 24 and top cover 22.

Figure 2:
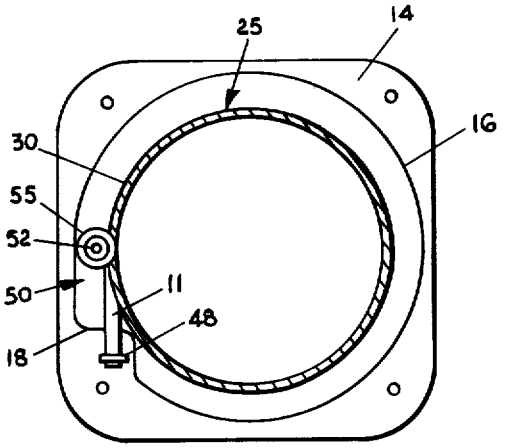
FIG. 2 is a cross-sectional plan view of the hose reel apparatus taken along plane II—II of FIG. 1.
Figure 3:
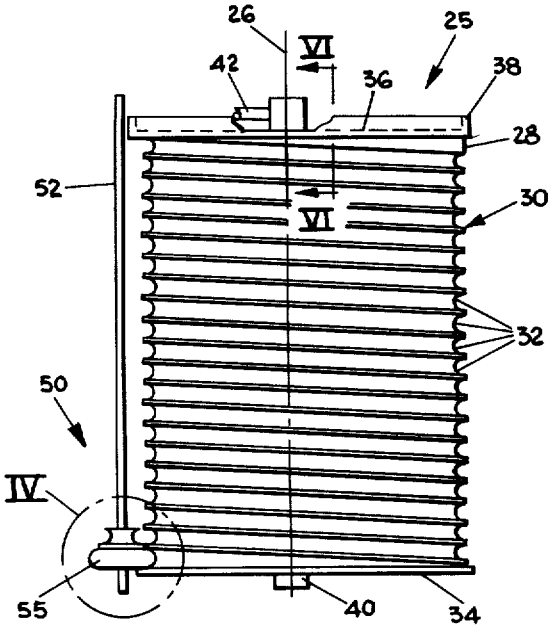
FIG. 3 is an elevation of the cylindrical hose reel of the present invention.
Figure 5:
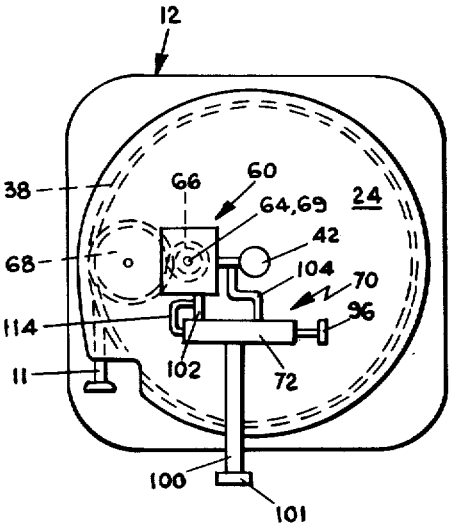
FIG. 5 is a plan view of the fluid control apparatus of the present invention taken along plane V—V of FIG. 1.
Figure 4:
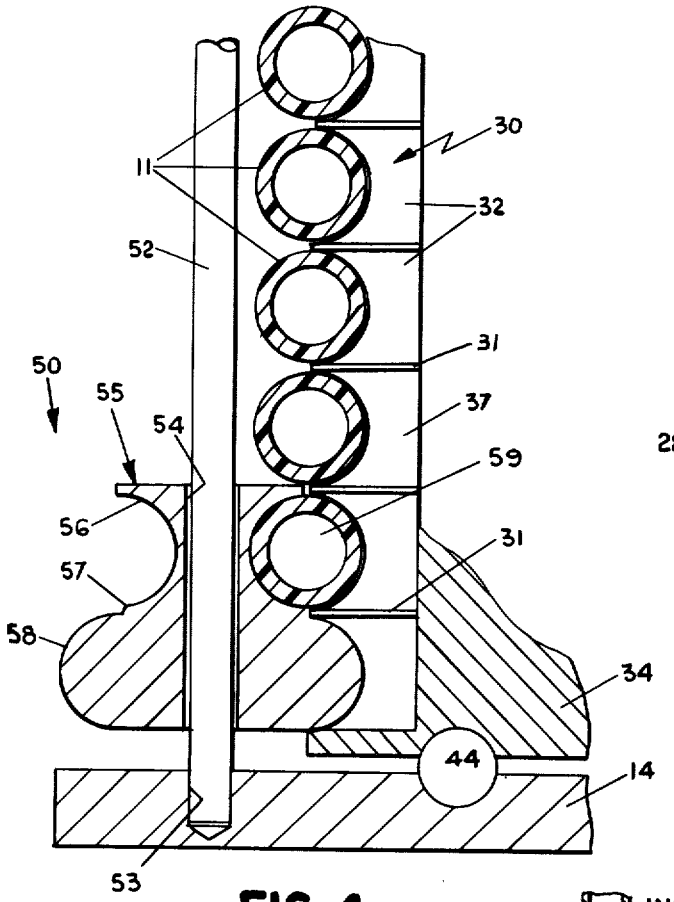
FIG. 4 is an enlarged, fragmentary, sectional view of the even wind mechanism and a portion of the cylindrical hose reel taken in area IV of FIG. 3.

Referring to FIGS. 2, 3, and 4, reel 25 is a right, circular cylinder 28 including a continuous, helical groove 30 formed in and around the cylinder sides. The bottom end of the cylinder is covered by a plate 34 while the top portion is covered by a circular plate 36. Plate 36 includes an upstanding rim or flange 38 (FIGS. 3 and 5) extending parallel to the axis 26 and generally upwardly away from the cylinder 28 including a plurality of gear teeth on its inside surface for engaging appropriately sized teeth on gears associated with the fluid motor 60 as shown in FIG. 5. Axles 40 and 42 extending normally to circular plates 34 and 36 provide means for engaging the base 14 and platform 24 to support the reel vertically in its housing.

As is best seen in FIG. 4, a plurality of ball bearings 44 are included between the lower plate 34 and the base 14 in suitable, annular, aligned, receiving grooves formed in each part to support the reel rotatably about axis 26. The cylindrical portion 28 of reel 25 may be made tall enough to include a helical groove of sufficient length to accept any desired length of hose. Normally, the reel will be made in a standard size to accept standard length garden hoses or the like.

Figure 6:
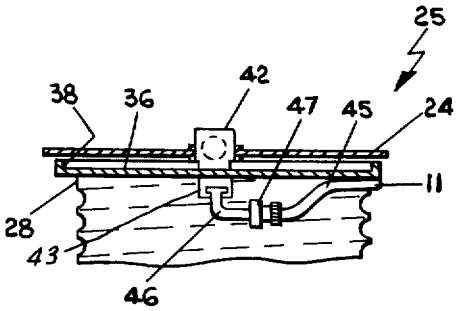
FIG. 6 is a fragmentary, sectional elevation of the swivel fluid connection of the hose reel taken along plane VI—VI of FIG. 3.

As seen in FIG. 6, axle 42 extending above circular plate 36 at the top of reel 25 also provides a liquid fluid inlet swivel coupling 43 to direct fluid from fluid valving 70 to the attached end 45 of a hose 11 wound on reel 25. Swivel coupling 43 is of the conventionally known type and also serves as a bearing for rotatably supporting the upper end of the reel. Further, the swivel coupling includes sealing means which prevent the leakage of fluids transmitted therethrough during such rotation. An elbow conduit 46 extends from the lower portion of the swivel coupling and includes a collar 47 for securing the end 45 of the hose thereto. The hose thereafter extends out through an aperture in the reel and is wound in helical groove 30 on the exterior of the reel. Thus, fluid is transmitted from the stationary valving 70 to the hose without leakage even while cylinder 25 is rotating.

Referring now to FIG. 4, the even wind mechanism for guiding the hose into the helical groove 30 includes a rod 52 having a circular cross section secured in aligned apertures 53 provided in base 14 and platform 24 adjacent the periphery of the reel 25. Rod 52 extends parallel to the axis 26 of cylinder 25 and is spaced a distance from the outer periphery thereof such that the groove following member 55 is slidably mounted thereon and matingly engaged with the groove 30.

Follower 55 includes an upper, annular, concave section 56 having its outer edge surface formed in a concave semicircular shape as shown in FIG. 4. A generally transverse, annular, connecting shoulder 57 extends between one edge of the annular concave section 56 and a lower, annular, convex section 58 forming the lower portion of the cylinder 55. The outer edge surface of convex section 58 is formed in a convex, semicircular shape which mates with the concave, semicircular shape of the helical groove 30. The ridges 31 between the individual coils 32 extend adjacent the shoulder 57. A longitudinal bore 54 extending generally perpendicular to the planes of the annular convex and concave sections 56 and 58 extends through the follower 55 for axially movably supporting the follower on rod 52.

As will be understood from FIG. 4, convex section 58 engages a portion of groove 30 spaced axially parallel to the axis 26 from another portion of groove 30 which is adjacent concave section 56. Concave section 56 adjacent the other coil 32 forms a space 59 having a substantially circular cross-sectional shape which receives the generally circular cross-sectional shape of hose 11. Since follower 55 is slidably mounted on rod 52, rotation of the cylinder 25 with convex section 58 mating with helical groove 30 causes the follower 55 to be advanced axially parallel to the axis of the cylinder and to receive and guide the hose 11 into the portion of groove 30 immediately above the convex section 58. Accordingly, the guiding portion of the follower is positioned immediately adjacent the groove portion into which the hose is directed resulting in a more positive efficient wrapping of the hose.

Figure 7:
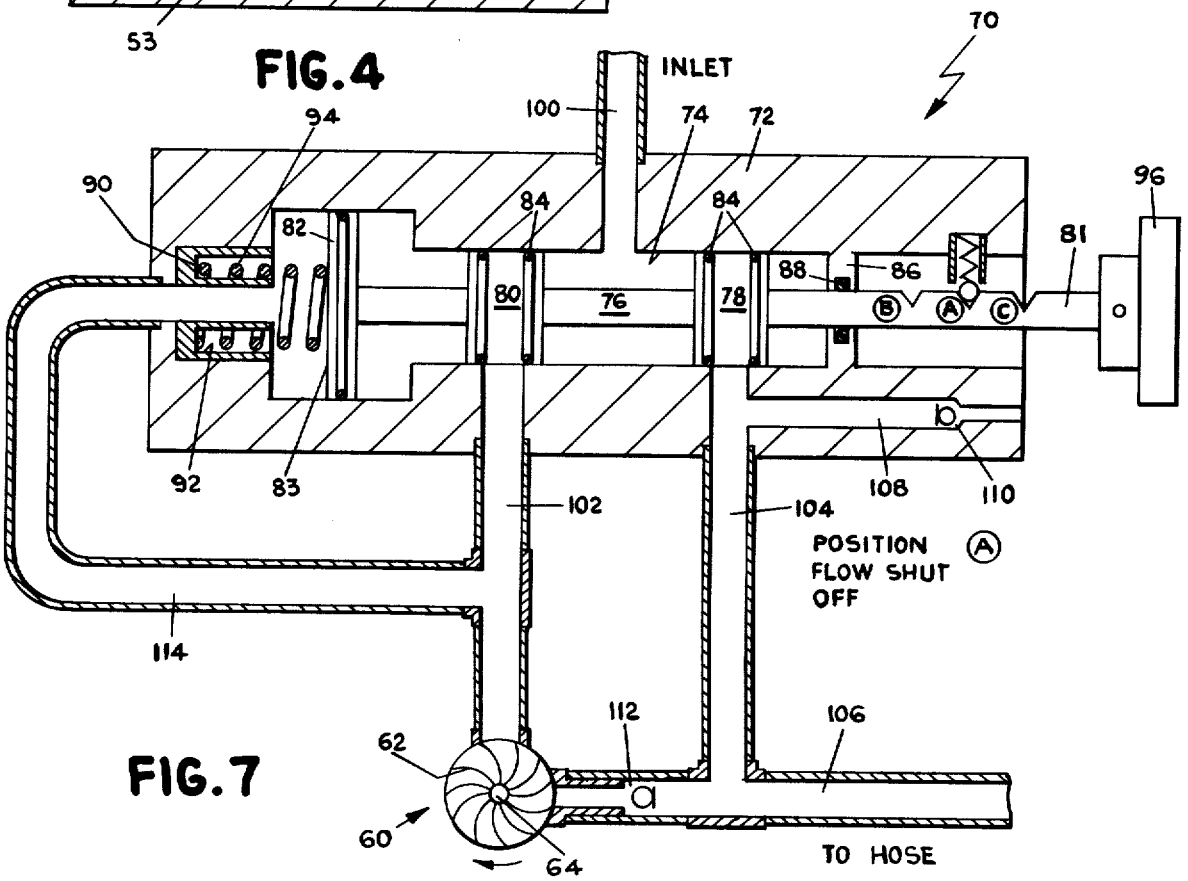
FIG. 7 is a sectional illustration of the fluid valving of the present invention shown in the closed portion wherein fluid is prevented from flowing through the fluid motor and hose and residual fluid is being drained from the rewound hose.
Figure 8:
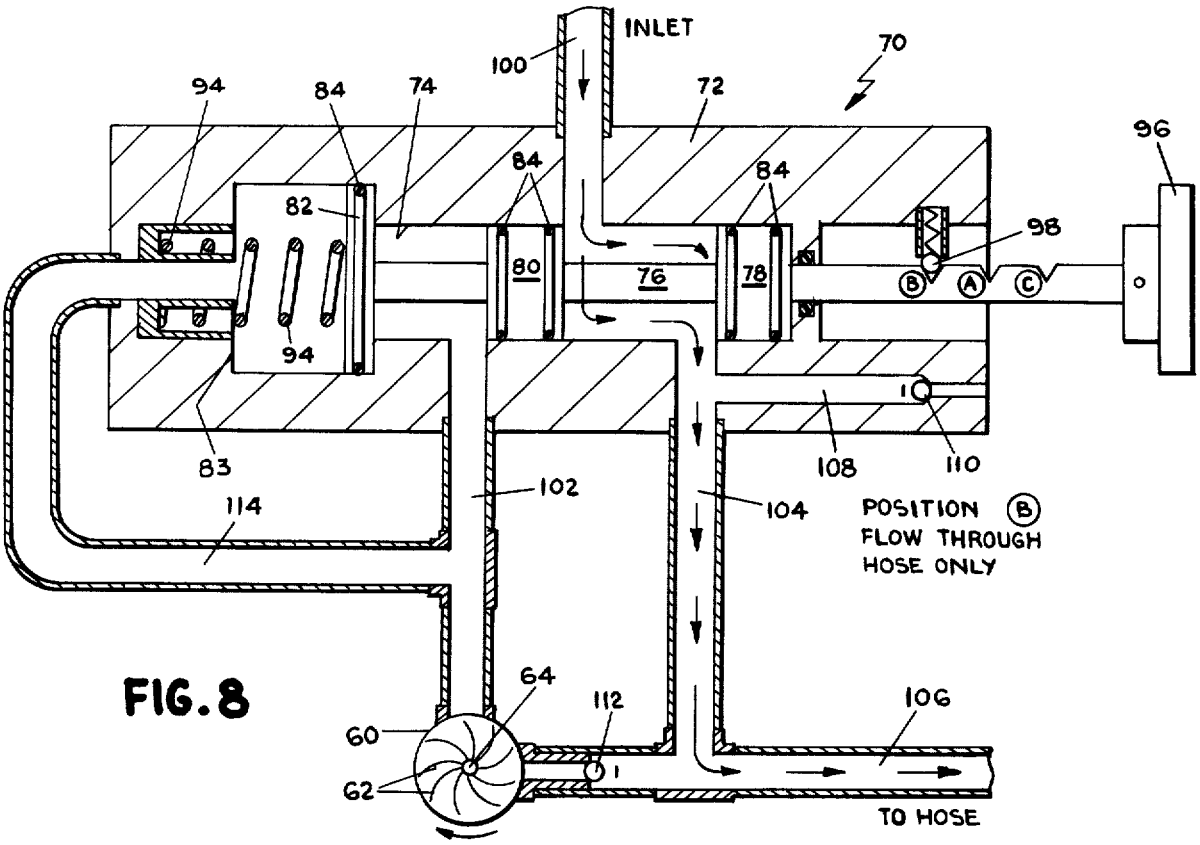
FIG. 8 is a sectional illustration of the fluid valving of FIG. 7 in position to direct fluid through the hose.
Figure 9:
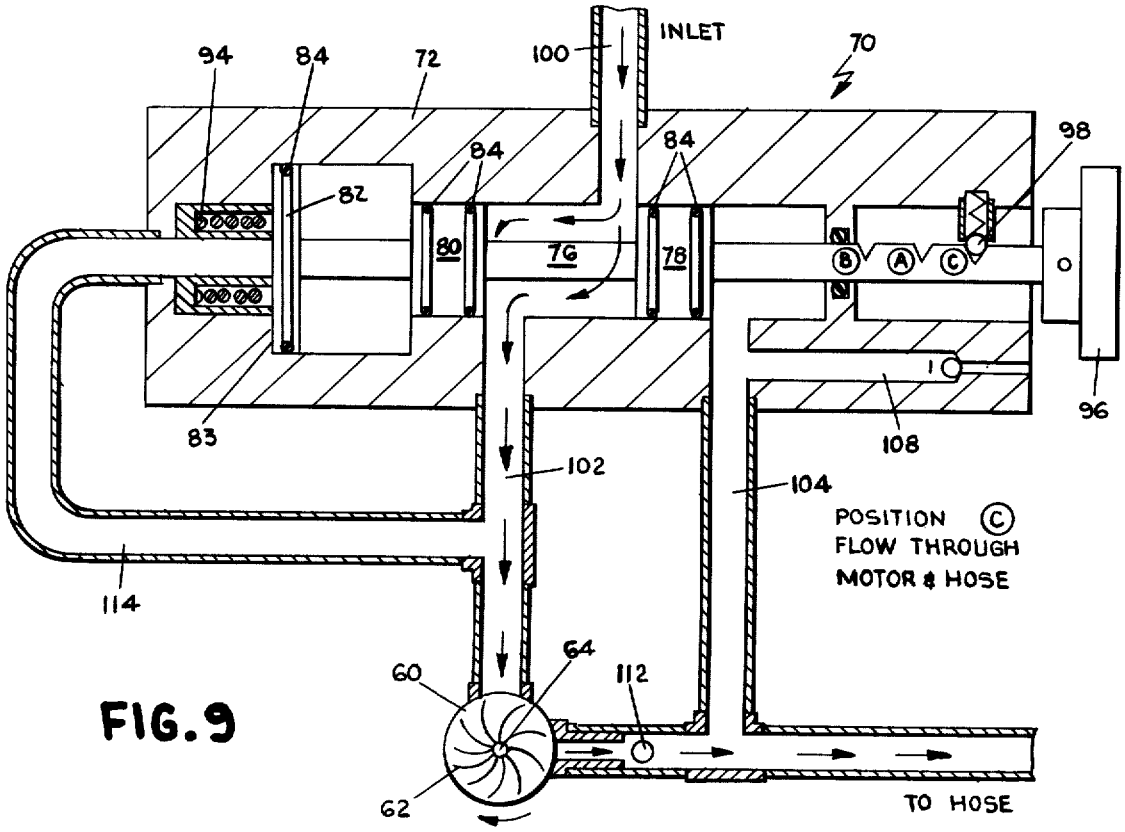
FIG. 9 is a sectional illustration of the fluid valving of FIGS. 7 and 8 in position to direct fluid through both the hydraulic motor and the hose.

Referring now to FIGS. 5 and 7–9, fluid motor 60 is positioned and secured on platform 24 generally above the top plate 36 of the reel 25. Fluid motor 60 is of the type including a series of impeller blades 62 secured to a shaft 64 (FIGS. 7–9). The blades and shaft are driven by the force of a stream of liquid directed thereon from fluid valve means 70. Shaft 64 in turn drives a small gear 66 having a plurality of gear teeth therearound and engaging the toothed periphery of another gear wheel 68 positioned between small gear 66 and the toothed rim 38 of hose reel 25 (see FIGS. 1 and 5). Hence, when valve apparatus 70 is positioned to direct a stream of fluid into motor 60, gears 66 and 68 will be rotated thereby imparting a rotation to reel 25 via rim 38 to wind the hose 11 thereon.

Typical hydraulic fluid powered motors which may be used in the present invention include the "Tru-Test Sprinkler" motor manufactured by International Plumbing Products Company of Freeport, New York, and motors manufactured by Servess of Princeville, Illinois. Although these motors typically include shafts driven by streams of fluid impinging on impeller blades secured thereto, other types of fluid motors may also be used. Provision may also be made for driving shaft 64 via a hand crank inserted in a suitably provided aperture in the fluid motor such as aperture 69 shown in the top of motor 60 in FIGS. 1 and 5.

Electric motors or other motive power means may also be used to power the rotation of the reel. An electric motor would require appropriate switches coordinated with the reel to start and stop the motor at appropriate times. If such other motive power sources were used, the invention would include appropriate fluid valving to shut off flow through the hose. For instance, shaft 64 would be connected to the drive shaft of an electric motor for rotating the reel. When a predetermined amount of hose was rewound, limit switches would shut off the electric motor and blades 62 would be stopped. The resulting back pressure would then shut off fluid flow through the fluid valving and hose as is described below.

As shown in FIGS. 7–9, the fluid valve apparatus 70 includes a housing 72 including a central bore 74 extending through the middle thereof. Bore 74 receives a spool shaft 76 including enlarged, circular, cylindrical sections or lands 78, 80, and 82 spaced axially along the shaft 76. Land 82 has a diameter larger than either enlargement 78 or 80 providing a greater surface area on end 83 of the spool shaft than is provided on either side of either of the lands 78 or 80. Lands 78, 80, and 82 mate with the interior of the bore 74 and are sealed with suitable sealing means such as O rings 84 mounted in annular grooves in each of the lands. Additionally, annular shoulder 86, adjacent end 81 of the spool shaft, includes an O ring 88 providing a seal for closing the end of bore 74 opposite end 83 of the spool shaft. The various lands on shaft 76 and shoulders in bore 74 therefore define fluid flow chambers or spaces therebetween. An annular member 90 is positioned adjacent end 83 of the spool shaft and includes annular channel 92 therein for receiving a coil spring 94 which helps bias the entire spool shaft 76 toward the right in FIGS. 7–9.

End 81 of the spool shaft includes a knob 96 for positioning the spool shaft in one of three positions A, B, or C as shown in FIGS. 7–9. The spool shaft is held in a desired position unless moved axially by fluid pressure and the force of spring 94 by a spring-biased ball 98 engaging one of three detents A, B, or C spaced axially along spool shaft 76 adjacent end 81.

Fluid flow to and from the valve apparatus 70 is provided by liquid supply inlet 100, which includes a coupling 101 for attaching the inlet to a standard water faucet of a house or other dwelling as shown in FIG. 5, and a pair of fluid outlet conduits 102 and 104. Conduit 102 extends to fluid motor 60 providing a stream of fluid for driving that motor while conduit 104 extends into communication with conduit 106, the outlet for fluid motor 60. A fluid passageway 108 is provided in the housing 72 for admitting atmospheric pressure through a suitable check valve 110 shown schematically mounted in passageway 108. Another check valve 112 is shown schematically in FIGS. 7–9 and mounted adjacent the outlet of motor 60 in conduit 106. A fluid conduit 114 extends from conduit 102 to the end of bore 74 in housing 72 providing a passageway for admitting fluid against the end 83 of the spool shaft 76. The opposite end of conduit 106 is connected to the swivel coupling 43 at the upper end of the reel 25 to provide fluid flow through the hose 11.

The operation of the valve apparatus 70 and the reel apparatus will now be apparent. The operation is controlled by positioning shaft 76 in position A (FIG. 7), position B (FIG. 8), or position C (FIG. 9). In position A, all fluid flow is stopped. Position B causes fluid flow through the hose. Position C causes rewinding of the hose on the reel and fluid flow through the hose. When the hose is rewound to a predetermined point, fluid pressure causes the spool shaft to be moved from position C to position A, shutting off all fluid flow.

Normal use of the apparatus begins with the spool valve 76 positioned as shown in FIG. 7. In this position, lands 78 and 80 cover the mouths of conduits 102 and 104 preventing the flow of fluid from inlet 100 to either of those conduits. Hence, fluid does not flow either through fluid motor 60 or through the hose 11. Since there is no fluid pressure in line 104, the check valve 110 opens and atmospheric pressure is introduced into the hose 11 through passageway 108, conduits 104 and 106. The atmospheric pressure causes the fluid remaining in hose 11 to be drained from the free end of the hose positioned adjacent the bottom of the hose reel as shown in FIGS. 1 and 2. Check valve 110 and passageway 108 are located at the top of the hose reel apparatus thereby facilitating drainage from top to bottom through the wound hose.

When it is desired to have liquid flow through hose 11, spool valve 76 is pulled axially to the right with knob 96 such that spring-biased ball 98 seats in detent B as shown in FIG. 8. In this position, flow from inlet 100 passes around spool shaft 76 between lands 78 and 80 through conduit 104 and conduit 106 and on out through hose 11. Fluid is prevented from passing through fluid motor 60 by the position of land 80 between inlet 100 and the mouth of conduit 102 in bore 74. Spring 94 and biased ball 98 retain the shaft in position B. Fluid passing through conduit 104 enters passageway 108 to close check valve 110 thereby preventing the entry of atmospheric pressure when the spool valve is positioned in position B. The same fluid pressure in conduit 106 closes check valve 112 to prevent leakage back through motor 60.

After use of the unwound hose 11 is concluded and it is desired to rewind the hose on reel 25, spool 76 is pushed axially to the left into position C as shown in FIG. 9. In this position, flow from inlet 100 passes around spool 76 between lands 78 and 80 through conduit 102, fluid motor 60, and on out through conduit 106 and hose 11. The spool is retained in position C by the force of ball 98 in detent C which balances the force of spring 94 acting against end 83. Passage of fluid through fluid motor 60 causes the rotation of shaft 64 by impeller blades 62 imparting a rotation to reel 25 and causing the hose 11 to be wound in helical groove 30 of the reel by follower 55 in the manner described above.

When a predetermined amount of hose 11 is rewound on reel 25, normally the entire hose, an abutment or enlargement on the hose engages a restricted portion of the vertical aperture 20 (FIG. 1) preventing rotation of the reel 25. Normally, the hose coupling 48 (FIGS. 1 and 2) at the free end of hose 11 will engage opening 20 when the hose has been completely rewound. However, other abutments such as a collar or the like may be clamped at any position along the length of the hose to stop the rotation of the reel when a desired length of hose has been rewound.

When the reel is stopped from rotating in the above-described manner, gears 66, 68, and shaft 64 cannot rotate, fluid cannot move blades 62 of motor 60, and therefore, fluid cannot pass out through the outlet of the motor. The stream of fluid thus cannot enter inlet 100 causing a back-pressure upstream of the motor. Such back-pressure causes the fluid to be directed through conduit 114 and against end 83 of spool 76. The force of the fluid against the large cross-sectional area of the end 83 of spool 76 in combination with the biasing force of spring 94 overcomes the force of ball 98 in detent C causing the spool 76 to move axially to the right in FIG. 9. Such axial movement returns spool 76 to position A as shown in FIG. 7. Further movement of the spool to the right past position A is prevented by the sealing of the mouth of conduit 102 by land 80 in position A. Thus, when rotation of the reel 25 is stopped when a predetermined amount of hose is reeled thereon, the fluid pressure is increased against end 83 of the spool forcing the spool to the right to close off the flow of fluid through both the fluid motor 60 and hose 11. Check valve 110 is closed in position C by the force of fluid in conduit 104 and passage 108.

Preferably, housing 72, spool shaft 76, and the fluid conduits are all formed from a noncorrosive, synthetic material or plastic which may be molded in the configuration shown in FIGS. 7–9. Although such synthetic materials are preferable to prevent corrosion and to provide more durability and longer life for the apparatus, other more conventional materials may also be used such as cast iron, steel, brass, or the like.

While one form of the invention has been shown and described, other forms will now be apparent to those skilled in the art. Therefore, the embodiment shown in the drawings and described above is merely for illustrative purposes and is not intended to limit the scope of the invention which is defined by the claims which follow.

The embodiments of the invention in which an exclusive property or privilege is claimed are defined as follows:

1. Hose reel apparatus comprising in combination, a cylindrical hose reel; support means for rotatably supporting said reel on an axis of rotation; winding means for directing and guiding a hose around and along said reel as said reel is rotated on said axis including fluid motive power means on said support means for rotating said reel about said axis; fluid valve means for controlling operation of said fluid motive power means and for controlling fluid flow to a hose on said reel when the hose is connected to said fluid valve means, said fluid valve means having a first fluid conducting means for admitting and directing fluid through the hose, a second fluid conducting means for directing said fluid through said fluid motive power means for rotating said reel to wind the hose on said reel prior to the passage of the fluid through the hose, and movable valve sealing means responsive to a fluid pressure increase for closing said first and second fluid conducting means and shutting off the flow of said fluid through said fluid motive power means and the hose on said reel; and fluid control means responsive to the winding of a predetermined amount of hose on said reel for providing an increase in fluid pressure in said fluid valve means whereby the increase in fluid pressure moves said valve sealing means to shut off fluid flow through the hose and stop rotation of said reel when the predetermined amount of the hose is wound on said reel.

2. The apparatus of claim 1 wherein said fluid control means include means for restraining rotation of said reel about said axis when the predetermined amount of hose is wound on said reel whereby a back-pressure is built up in said fluid valve means and moves said movable valve sealing means.

3. The apparatus of claim 2 including a housing surrounding said reel and having an aperture extending parallel to said axis through which the hose is passed during winding and unwinding from said reel; said reel rotation restraining means comprising a restricted area of said housing aperture for engaging an enlargement along the length of the hose to prevent further winding of the hose on said reel.

4. The apparatus of claim 1 wherein said winding means include a helical groove extending around the exterior of said reel and a hose guiding member axially slidably mounted along a rod extending parallel to but spaced from the circumference of said reel, said guiding member having a convex section matingly engaging one portion of said groove for axially moving said guiding member along said rod in response to rotation of said reel, and an annular, rounded, concave recess merging into said convex section for receiving and guiding the hose into another portion of said groove spaced axially along said reel from said one groove portion as said reel is rotated.

5. The apparatus of claim 1 including base means for vertically supporting said reel with said rotational axis extending vertically; a housing surrounding said reel mounted on said base means, said housing including a generally vertical elongated aperture for winding and unwinding said hose from said reel, said aperture including a restricted area preventing passage of an enlargement on the end on the hose when the hose is completely rewound; said enlargement on the end of the hose and said restricted area of said housing aperture comprising said fluid control means; said reel including a helical groove extending around its circumference; said winding means including guide means for following said groove and for receiving and guiding said hose into said groove as said reel is rotated.

6. The apparatus of claim 1 wherein said fluid valve means includes additional valve means responsive to a reduction in fluid pressure in said fluid valve means for admitting atmospheric pressure into the hose for draining said fluid from the hose when said flow of fluid has been shut off.

7. The apparatus of claim 6 wherein said fluid valve means includes a spool shaft axially movably mounted in a housing, sealing means on said spool shaft defining a plurality of chambers within said housing, a plurality of fluid conduits separately connected to said housing including a first fluid inlet conduit directing fluid to said chambers, a first fluid outlet conduit comprising said first fluid conducting means for directing fluid through said hose while bypassing said fluid motive power means, a second fluid outlet conduit comprising said second fluid conducting means for directing fluid to said fluid motive power means, and a second fluid inlet conduit connected to said first outlet intermediate said housing and fluid motive power means for transmitting said increased fluid pressure against said spool shaft whereby said spool is axially moved to shut off said fluid flow through both said first and second fluid outlet conduits when said predetermined amount of the hose is wound on said reel; means for holding said spool in a plurality of desired axial positions such that said spool shaft will direct fluid from said first inlet to at least one of said first and second fluid outlets and said second fluid inlet.

8. The apparatus of claim 7 wherein said fluid motive power means includes impeller blade means for preventing fluid flow therethrough and for increasing fluid pressure in said second inlet when said reel is prevented from rotating; abutment means adapted to engage an enlargement on the hose for preventing rotation of said reel when said predetermined amount of the hose is wound on said reel; biasing means acting in combination with said increased fluid pressure against said spool shaft for axially moving said spool shaft to shut off said flow; said holding means including a plurality of detents spaced axially along said spool shaft and detent engaging means biased against said detents for resisting movement of said spool shaft.

9. The apparatus of claim 7 including an additional fluid conduit connecting said second fluid outlet conduit with the atmosphere; said additional fluid conduit including said atmospheric pressure admitting valve means comprising a check valve which prevents fluid from escaping from said additional fluid conduit when fluid is directed through said second fluid outlet conduit and allows atmospheric pressure to be admitted through the hose when no fluid pressure is present within said second fluid outlet conduit; and check valve means located adjacent the outlet from said fluid motive power means for preventing fluid from flowing in reverse through said fluid motive power means.

10. The apparatus of claim 9 including fluid conducting means for providing fluid communication between said fluid outlet of said fluid motive power means and said atmospheric pressure check valve to prevent entrance of atmospheric pressure into the hose when fluid is directed through said fluid motive power means.

11. Hose reel apparatus comprising in combination, a cylindrical hose reel; support means for rotatably supporting said reel on an axis of rotation; fluid motive power means on said support means for rotating said reel about said axis; guide means mounted for movement along the side of said reel generally parallel to said reel axis and engaging the side of said reel for receiving, guiding, and wrapping a hose evenly around and axially along said reel as it is rotated on said axis; fluid valve means for controlling a flow of fluid through the hose and for controlling a flow of fluid through said fluid motive power means to wind the hose on said reel including first fluid conduit means for directing said fluid through the hose, second fluid conduit means for directing said fluid into said fluid motive power means, movable valve sealing means responsive to a change in fluid pressure for shutting off the flow of fluid through said first and second fluid conduit means and thus the hose when said reel is prevented from rotating; and fluid control means for preventing rotation of said reel when a predetermined amount of hose is wound on said reel, said fluid control means including means responsive to said prevention of rotation of said reel for changing the fluid pressure in a portion of said fluid valve means whereby when said reel is prevented from rotating by said control means, said valve sealing means is moved to shut off fluid flow to both said hose and fluid motive power means.

12. The apparatus of claim 11 wherein said fluid control means include means on said support means for abutting and preventing passage of an enlarged portion of the hose, the hose including an end adapted for connection to said reel, a free end, and an enlarged portion positioned a predetermined distance from the free end of the hose; said fluid motive power means including a fluid inlet connected to said second fluid conduit and a fluid outlet connected to said hose; said valve sealing means being movable between at least a first position directing fluid flow through said second fluid conduit and thus through said fluid motive power means and into said hose and a second position closing off the flow through said second fluid conduit and thus said fluid motive power means and hose; said means responsive to said fluid control means for changing the fluid pressure including fluid flow restriction means for producing a back-pressure at said fluid inlet to said fluid motive power means and thus in said second fluid conduit and additional fluid conduit means connected to said second fluid conduit for directing fluid pressure against said valve sealing means upon the occurrence of said back-pressure to move said valve sealing means to said second position.

13. In a hose reel apparatus of the type including a cylindrical hose reel, support means for supporting said hose reel for rotation about a rotational axis, means for rotating said reel about said axis to wind a hose thereon, and valve means for directing a fluid through the hose, the improvement comprising a hose receiving and guiding means for evenly winding the hose on said reel, said guiding means including a helical groove extending around and axially along said cylindrical reel, a support rod positioned parallel to said reel axis and spaced from said reel, and a guide member mounted for axial movement along said rod; said guide member including an annular convex section having a shape corresponding to the cross-sectional shape of said groove in mating engagement with one portion of said groove, an annular concave section flaring inwardly from said convex section and located adjacent another portion of said groove spaced a distance parallel to said reel axis from said one groove portion for engaging and guiding the hose, and a longitudinal bore extending transversely through said annular sections for receiving said rod whereby rotation of said reel with said helical groove moves said guide member along said rod to guide said hose into said reel.

14. The improvement of claim 13 wherein said helical groove, said annular concave section, and said annular convex section each have the cross-sectional shape of a semicircle.

15. Hose reel apparatus comprising in combination, a cylindrical hose reel; support means for rotatably supporting said reel on an axis of rotation; winding means for directing and guiding a hose around and along said reel as said reel is rotated including motive power means on said support means for rotating said reel about said axis; fluid valve means for controlling fluid flow to a hose on said reel when the hose is connected to said fluid valve means including fluid conducting means for admitting and directing fluid through the hose, movable valve sealing means responsive to a fluid pressure increase for closing said fluid conducting means and shutting off the flow of said fluid through the hose on said reel; and fluid control means responsive to the winding of a predetermined amount of hose on said reel for providing an increase in fluid pressure in said fluid valve means whereby the increase in fluid pressure moves said valve sealing means to shut off flow through said hose when a predetermined amount of the hose is wound on said reel.

16. The apparatus of claim 15 wherein said fluid control means for providing an increase in fluid pressure comprise means for restraining rotation of said reel about said axis when said predetermined amount of hose is wound on said reel whereby a back-pressure is built up in said fluid valve means and moves said movable valve sealing means.

* * * * *

UNITED STATES PATENT AND TRADEMARK OFFICE

CERTIFICATE OF CORRECTION

PATENT NO. : 3,939,862

DATED : February 24, 1976

INVENTOR(S) : William M. Booth

It is certified that error appears in the above-identified patent and that said Letters Patent are hereby corrected as shown below:

Column 1, line 10;
"liquid" should be --fluid--;
Column 2, line 15;
"portion" should be --position--;

Signed and Sealed this

Third Day of August 1976

[SEAL]

*Attest:*

RUTH C. MASON
*Attesting Officer*

C. MARSHALL DANN
*Commissioner of Patents and Trademarks*